US006142124A

United States Patent [19]

Fischer et al.

[11] Patent Number: 6,142,124

[45] Date of Patent: Nov. 7, 2000

[54] METHOD AND DEVICE FOR CONTROLLING A LOAD

[75] Inventors: Werner Fischer, Heimsheim; Dietbert Schoenfelder, Gerlingen, both of Germany

[73] Assignee: Robert Bosch GmbH, Stuttgart, Germany

[21] Appl. No.: 09/132,806

[22] Filed: Aug. 13, 1998

[30] Foreign Application Priority Data

Aug. 16, 1997 [DE] Germany ..... 197 35 560

[51] Int. Cl.[7] ..... F02M 51/00; H01H 47/00

[52] U.S. Cl. ..... 123/490; 361/155

[58] Field of Search ..... 123/490; 361/154, 361/155

[56] References Cited

U.S. PATENT DOCUMENTS 5,592,921 1/1997 Rehbichler ..... 123/490
5,731,946 3/1998 Kahr ..... 361/154
5,835,330 11/1998 Kirschner et al. ..... 361/152
5,892,649 4/1999 Kahr et al. ..... 361/154

FOREIGN PATENT DOCUMENTS 0 681 100 11/1995 European Pat. Off. .
196 46 052 5/1998 Germany .
1 479 343 7/1977 United Kingdom .
2 028 048 2/1980 United Kingdom .
2 319 415 6/1996 United Kingdom .

*Primary Examiner*—Henry C. Yuen
*Assistant Examiner*—Arnold Castro
*Attorney, Agent, or Firm*—Kenyon & Kenyon

[57] ABSTRACT

A method and a device for controlling a load, in particular a solenoid valve for controlling the quantity of fuel to be injected. The load receives a bias current value before being activated. This bias current value is adapted.

16 Claims, 3 Drawing Sheets

METHOD AND DEVICE FOR CONTROLLING A LOAD

FIELD OF THE INVENTION

The present invention relates to a method and a device for controlling a load and, in particular, to a solenoid valve for controlling the quantity of fuel to be injected into an internal combustion engine.

BACKGROUND INFORMATION

A method and a device for controlling a load are known from German Published Patent Application No. 196 46 052, in which the load receives a bias current value before the actual activation, which results in an injection of fuel. This bias current value leads to a magnetic bias of the load. The bias current value is selected so that it is not sufficient to move the load into its new position. At the actual start of activation, only a small amount of additional energy is necessary, i.e., a slight current rise and thus only a short amount of time until the load begins to move. The bias current greatly shortens the switching time of the solenoid valve.

The switching time of the solenoid valve is the period of time between the start of activation and complete opening or closing of the solenoid valve. To be able to achieve the most accurate possible injection, this switching time should be as short as possible.

To be able to achieve a short switching time, the highest possible value for the bias current value is desired. Nevertheless, if the bias current selected is too high, this will result in the solenoid valve switching before the actual activation.

SUMMARY OF THE INVENTION

An object of the present invention is to predetermine the bias current value with a method and a device for controlling a load so that the load will switch reliably in the shortest possible switching time. With the method according to the present invention, loads can be switched reliably, and the switching time of the load is very short.

DETAILED DESCRIPTION

In an embodiment of the present invention, the load is a coil of a solenoid valve which influences fuel metering into an internal combustion engine. The start of injection, the end of injection, and thus the quantity of fuel injected can be controlled by activation of this solenoid valve. To do so, it is necessary for the solenoid valve to open and/or close at a defined time. In addition, it is advantageous, in particular with diesel engines, if the solenoid valve reaches its new end position as quickly as possible after the activation signal is output. In other words, the switching time of the solenoid valve should be as short as possible.

Figure 1:
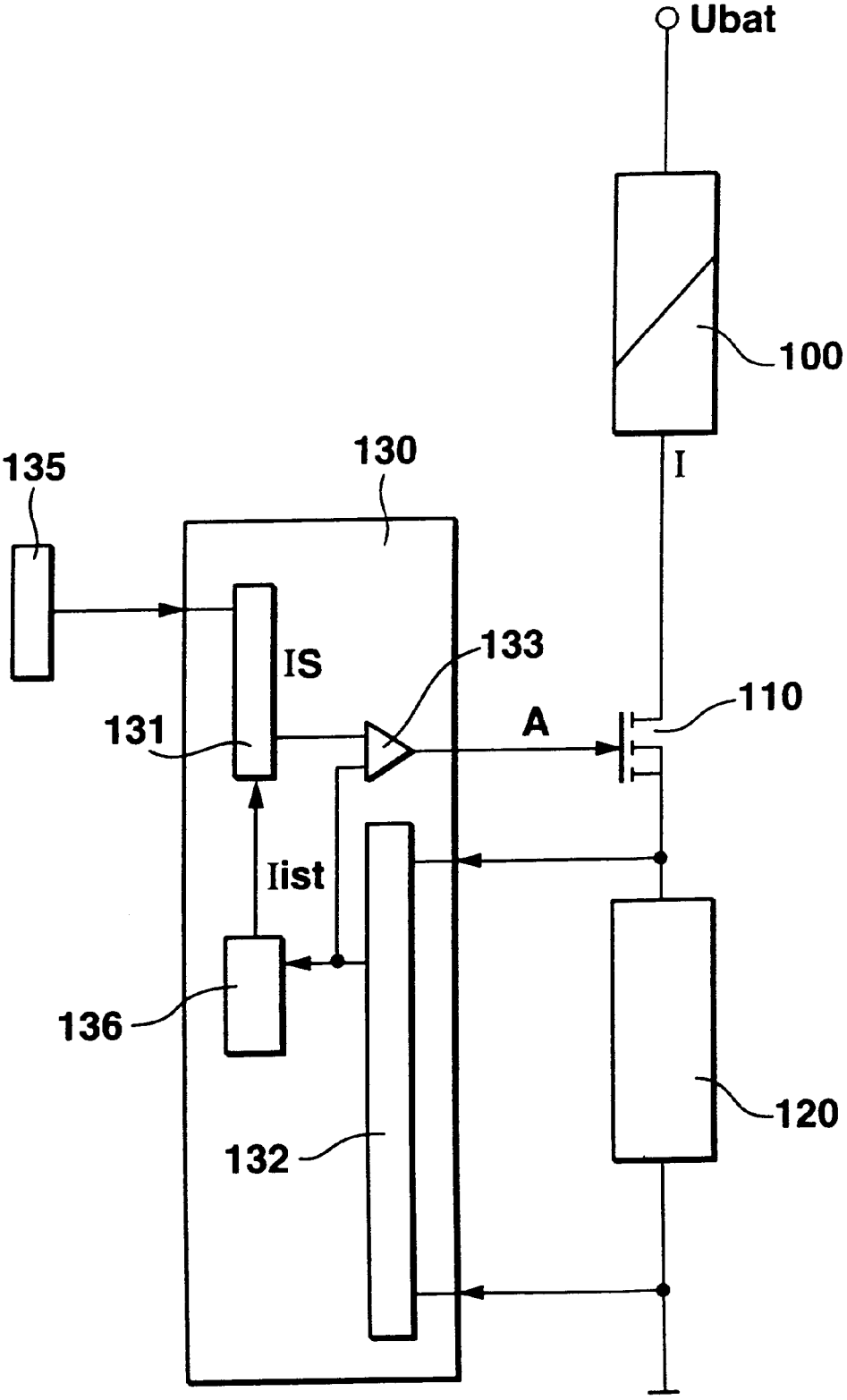
FIG. 1 shows a block diagram of the device according to the present invention.

FIG. 1 shows a schematic diagram of the main elements of the device according to the present invention. The electromagnetic load is labeled 100. Its first terminal is connected to a power supply voltage Ubat. Its second terminal is connected to a control device 110, which may comprise a switching device.

The control device 110 is preferably a transistor, in particular a field-effect transistor. In this case, the second terminal of the load 100 is connected to the drain terminal of the field-effect transistor 110. The source terminal of the transistor 110 is connected to a current-measuring device 120 for detecting the current flowing through the load 100. The second terminal of current-measuring device 120 is connected to ground.

The arrangement of these three elements is shown only as an example. Thus, these elements may also be arranged in any other order. For example, the ground and battery terminals could be interchanged.

Current-measuring device 120 is preferably implemented as a resistor. The two terminals of resistor 120 are sampled by a control unit 130. The two voltage values are sent to a current detector 132, which supplies an actual current value list based on the voltage drop across resistor 120. This actual value list is sent to controller 133 as an actual value. The second terminal of controller 133 is connected to a control 131 which supplies a setpoint IS to the second input. The output of controller 133 supplies a corresponding activation signal A to the gate of transistor 110.

Various sensors 135 supply various signals indicating the operating state of the internal combustion engine or motor vehicle to be controlled. These signals are sent to control unit 130 or control 131.

In addition, an adaptor 136 that supplies actual value list at least is also provided. The adaptor 136 supplies a signal to control 131. It is also especially advantageous if the adaptor 136 is part of control 131.

Figure 2A:
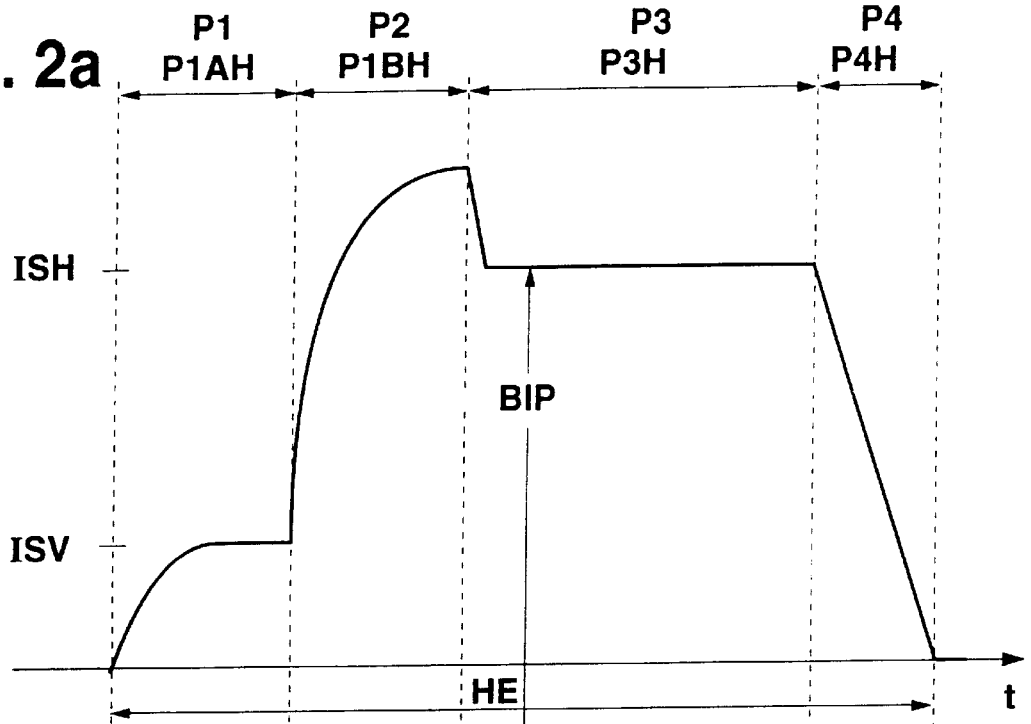
FIG. 2*a* shows a first signal plotted over time.
Figure 2B:
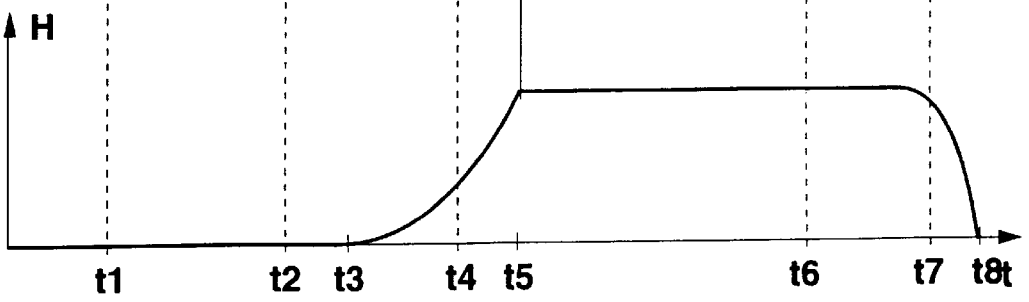
FIG. 2*b* shows a second signal plotted over time.

The functioning of this device in FIG. 1 is explained below on the basis of FIGS. 2*a* and 2*b*. Current I flowing through the load 100 is plotted over time t in FIG. 2*a*, and travel H of the solenoid valve needle is plotted over time t in FIG. 2*b*.

The control 131 calculates activation signal A to be sent to switching device 110 on the basis of performance characteristics detected by sensors 135. Desired start of injection t5, end of injection t7, and thus the injection quantity are selected on the basis of these performance characteristics. Then the times when switching device 110 is to be activated are selected on the basis of these quantities.

As an alternative, it is also possible to provide for signals to be delivered by another control unit, e.g., with regard to the desired start of injection and the desired end of injection, with these signals then being converted by control unit 130 into activation signals A for switching device 110.

In a first phase P1, the load 100 receives a bias current. This phase begins at instant t1 and ends at instant t2. After instant t1, current I through the load 100 rises from 0 to bias current value ISV. This bias current value ISV is selected so that the solenoid valve needle does not move.

Second phase P2 begins at instant t2. The actual activation of the load 100 begins at instant t2. Instant t2 establishes the start of injection. The second phase is also known as the start phase. In this phase, switching device 110 is activated so that the maximum possible current flows. As a result, the current rises very rapidly. The movement of the valve needle begins at instant t3, which is shortly after instant t2. This device that travel H increases slowly.

The setpoint for the current drops to holding value ISH at instant t4. The third phase, which is also called the holding current phase, begins at instant t4. The holding current is selected so that the valve needle remains in its end position. Between instants t4 and t5, the valve needle moves into its new position, reaching it at instant t5. Instant t5, which is when the valve needle reaches its new position, is known as the start of delivery or the switching instant (BIP).

The period of time between instant t2 and instant t5 is known as the switching time. Instant t5, when the valve needle of the solenoid valve reaches its new end position, can be detected by suitable sensors or by analyzing the current flowing through the load 100, the voltage that is applied to the load 100, or other suitable quantities.

The third phase ends at instant t6, and fourth phase P4, which is also known as rapid reset, begins. Until instant t7, the valve needle remains in its position and then drops back to its starting value by instant t8. The same thing also applies to the current, which drops to 0 between instants t6 and t7. Instant t6 is selected by control 131 so that injection will end by desired instant t7.

As a rule, setpoint ISoll, which is different in the individual phases, is selected by the control 131. Setpoint ISV for the bias current value is selected in first phase P1, the maximum value is selected in phase P2, and holding current value ISH is selected in phase P3.

Current detector 132 analyzes the voltage drop at measuring shunt (e.g., resistor) 120 and supplies an actual value list for the current; like setpoint IS, this actual value is sent to controller 133. Controller 133 determines activation signal A for switching device 110 on the basis of the control deviation between the setpoint and the actual value. The setpoint for the current is preferably selected as a digital value.

Selection of bias current value ISV is problematic; it must not be too high, because in that case the valve needle would respond prematurely. If selected too low, only an insignificant shortening of switching time is obtained.

The following procedure is used to find the optimum value for bias current value ISV. The value for bias current value ISV is increased, and at the same time the effect on the solenoid valve switching time is observed. If the switching time changes significantly between two changes in bias current value, the bias current value thus reached is reduced by a safety margin. The maximum possible current level is then reached. This means that the bias current value is learned, taking into account the switching time, so that the shortest possible switching time is made possible.

Switching time can be reduced greatly by this measure.

Figure 3:
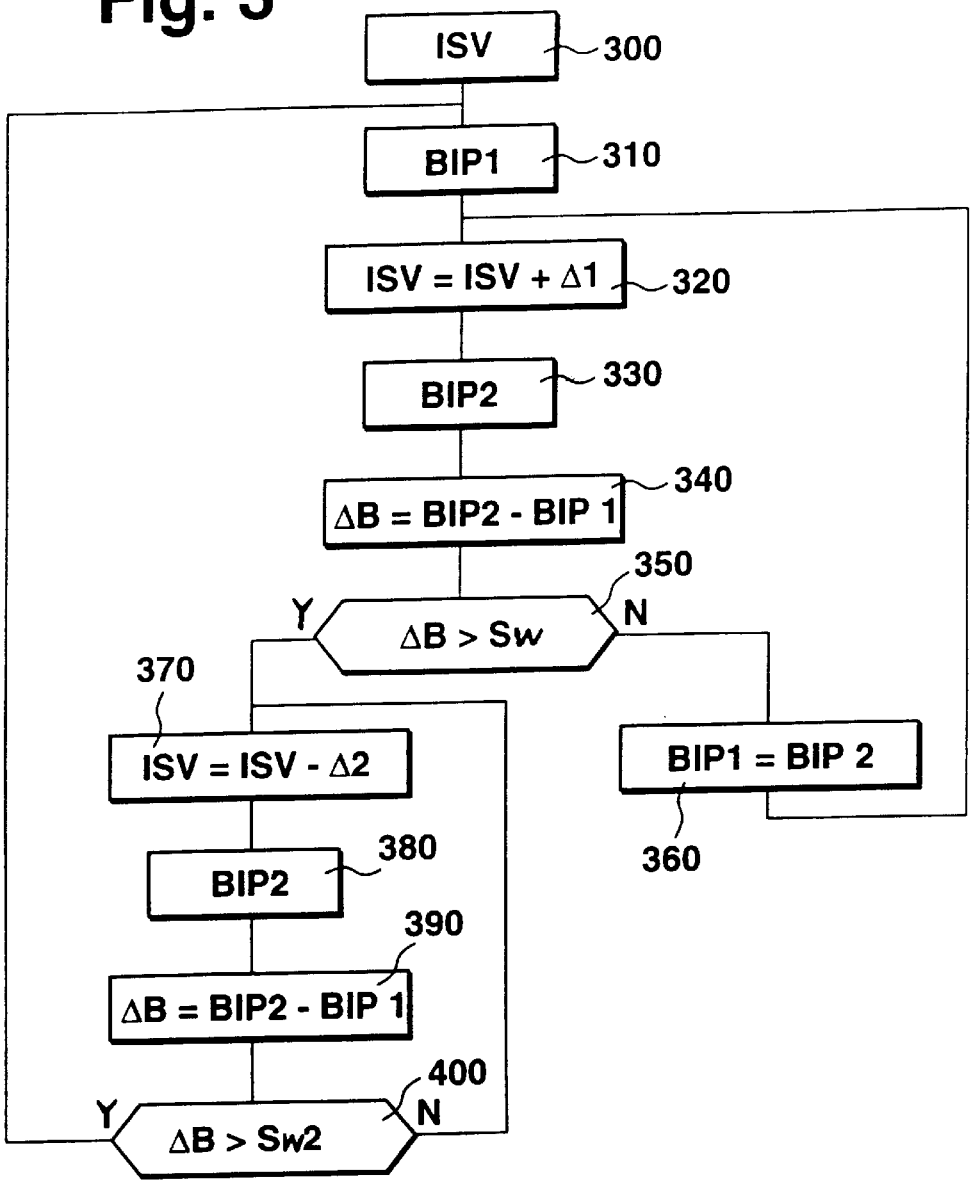
FIG. 3 shows a flow chart representing an operation of the present invention.

An embodiment of the method according to the present invention is shown in FIG. 3. In a first step 300, setpoint ISV for the bias current value is selected. This selection is preferably based on the various performance parameters of the internal combustion engine, in particular the temperature and rpm of the internal combustion engine.

In a second step 310, switching instant BIP1 is detected. Then in step 320, setpoint ISV is increased by a predetermined value Δ1. Next a new value BIP2 for the switching instant is detected in step 330. Step 340 calculates difference ΔB between new value BIP2 and old value BIP1 for the switching instant.

Inquiry 350 checks on whether this value ΔB is larger than a threshold value SW. If this is not the case, then old value BIP1 is overwritten with new value BIP2 in step 360. Next in step 320, setpoint ISV is increased again by fixed value Δ1.

This means that setpoint ISV is increased by value Δ1 until the switching time or switching instant changes by more than a threshold value SW. In other words, a definite change in switching time is established. If inquiry 350 detects that value ΔB is larger than threshold value SW, then setpoint ISV is reduced by a second value Δ2 in step 370. Next, switching instant BIP2 is detected in step 380. Step 390 forms difference ΔB between newly detected value BIP2 and value BIP1 detected before the reduction. Subsequent inquiry 400 checks on whether this value ΔB is larger than a threshold value S2. If this is the case, the program starts again with step 310. If this is not the case, bias current value ISV is reduced again by value Δ2 in step 370.

In the case of a sudden change in switching instant and/or a change in switching instant by more than a threshold value, bias current value ISV is reduced by a safety margin Δ2 according to the present invention. This reduction takes place until the significant change in switching instant is reversed. The bias current value determined in this way is then used to control the internal combustion engine.

Instead of the switching instant, it is also possible to use the switching time, i.e., the period of time between t2 and t5, for analysis.

In a simplified embodiment, steps 380, 390 and 400 can be omitted. In this case, the setpoint is merely reduced by safety margin Δ2, after which the system returns to step 310.

A fixed value is selected for safety margin Δ2. This is preferably equal to value Δ1 by which the bias current value is increased.

This method is preferably repeated cyclically during a driving cycle, i.e., it is repeated at predetermined intervals and/or after a certain number of engine revolutions.

Figure 4:
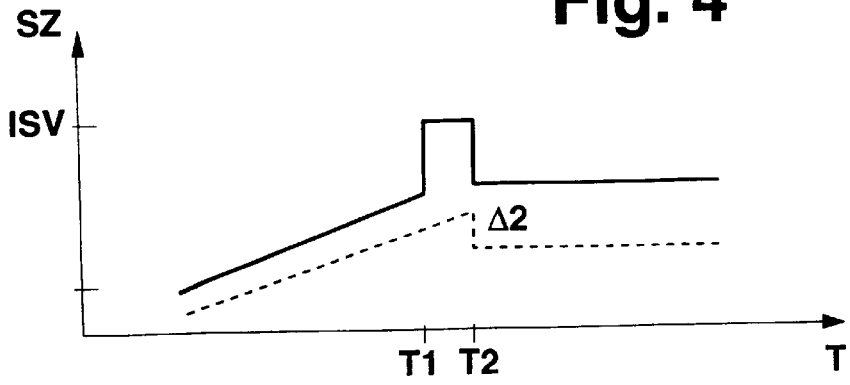
FIG. 4 shows the switching time plotted over time.

FIG. 4 shows the a plot of switching time SZ and setpoint ISV during the adaptor over time t. Setpoint ISV is plotted with a dotted line and switching time SZ with a solid line. Setpoint Ist, which reaches a maximum possible current level, is increased continuously. In contrast with the embodiment in FIG. 3, the embodiment illustrated in FIG. 4 has a linear increase in setpoint. Accordingly, switching time BIP also increases linearly with time. At instant T1, there is a sudden increase in switching time. In reaction to this sudden increase, setpoint ISV is reduced by a fixed value Δ2 at instant T2. Accordingly, the switching time drops back to its value before the sudden increase.

According to the present invention, the bias current value which is received by the load 100 before activation and which is not sufficient for the load 100 to respond is learned. Therefore, the bias current value is increased slowly until there is a significant change in switching time. A significant change is detected when there is a sudden change and/or a change by more than a predetermined value. After the significant change, the bias current value is reduced by a predetermined safety margin. The learning process is repeated in cycles during a driving cycle, preferably based on a starting value which depends on performance characteristics.

What is claimed is:

1. A method for controlling a load capable of receiving different current values in different phases, comprising the steps of:

before an activation of the load, receiving at the load a bias current value that is less than a current value for causing a response in the load;

adapting the bias current value as a function of a switching time of the load;

maintaining the bias current value at a predetermined level for a time period prior to activation of the load.

2. The method according to claim 1, wherein the load includes a solenoid valve for controlling a quantity of fuel injected into an internal combustion engine.

3. A method for controlling a load capable of receiving different current values in different phases, comprising the steps of:

before an activation of the load, receiving at the load a bias current value that is less than a current value for causing a response in the load; and adapting the bias current value as a function of a switching time of the load by:

increasing the bias current value, and analyzing a change in the switching time of the load.

4. The method according to claim 3, wherein the increase in the bias current value is based on a starting value that depends on performance characteristics of the load.

5. A method for controlling a load capable of receiving different current values in different phases, comprising the steps of:

before an activation of the load, receiving at the load a bias current value that is less than a current value for causing a response in the load; and adapting the bias current value as a function of a switching time of the load, wherein the step of adapting the bias current value includes the substeps of:

increasing the bias current value, analyzing a change in the switching time of the load, and reducing the increased bias current value by a safety margin when at least one of a sudden change in the switching time and a predetermined change in the switching time by more than a threshold value occurs.

6. The method according to claim 5, wherein the safety margin corresponds to a fixed predetermined value.

7. A method for controlling a load capable of receiving different current values in different phases, comprising the steps of:

before an activation of the load, receiving at the load a bias current value that is less than a current value for causing a response in the load;

adapting the bias current value as a function of a switching time of the load; and repeating cyclically the step of adapting the bias current value during a driving cycle.

8. A device for controlling a load, comprising:

an activation device supplying the load with different current values in different phases, wherein the load receives, before being activated, a bias current value that is less than a current value for causing a response in the load; and an arrangement adapting the bias current value as a function of a switching time of the load;

wherein the switching time of the load is shortened as a function of the adapted bias current value.

9. The device according to claim 8, wherein the load includes a solenoid valve for controlling a quantity of fuel injected into an internal combustion engine.

10. A method for controlling a load capable of receiving different current values in different phases, comprising the steps of:

before an activation of the load, receiving at the load a bias current value that is less than a current value for causing a response in the load; and adapting the bias current value as a function of a switching time of the load by:

increasing the bias current value, and reducing the increased bias current value by a safety margin when at least one of a sudden change in the switching time and a predetermined change in the switching time by more than a threshold value occurs.

11. A method for controlling a load capable of receiving different current values in different phases, comprising the steps of:

before an activation of the load, receiving at the load a bias current value that is less than a current value for causing a response in the load; and adapting the bias current value as a function of a switching time of the load, the switching time of the load being shortened as a function of the adapted bias current value.

12. A method for controlling a load capable of receiving different current values in different phases, comprising the steps of:

before an activation of the load, receiving at the load a bias current value that is less than a current value for causing a response in the load; and adapting the bias current value as a function of a switching time of the load by:

continuously increasing the bias current value until the bias current value reaches a predetermined threshold value, the predetermined threshold value being indicative of a minimum value at which the switching time of the load is shortened.

13. A device for controlling a load, comprising:

an activation device supplying the load with different current values in different phases, wherein the load receives, before being activated, a bias current value that is less than a current value for causing a response in the load; and an arrangement adapting the bias current value as a function of a switching time of the load, the arrangement performing the following:

increasing the bias current value, analyzing a change in the switching time of the load, and reducing the increased bias current value by a safety margin when at least one of a sudden change in the switching time and a predetermined change in the switching time by more than a threshold value occurs.

14. A device for controlling a load, comprising:

an activation device supplying the load with different current values in different phases, wherein the load receives, before being activated, a bias current value that is less than a current value for causing a response in the load; and an arrangement adapting the bias current value as a function of a switching time of the load, the arrangement performing the following:

increasing the bias current value, and reducing the increased bias current value by a safety margin when at least one of a sudden change in the switching time and a predetermined change in the switching time by more than a threshold value occurs.

15. A device for controlling a load, comprising:

an activation device supplying the load with different current values in different phases, wherein the load receives, before being activated, a bias current value that is less than a current value for causing a response in the load; and an arrangement adapting the bias current value as a function of a switching time of the load, the arrangement continuously increasing the bias current value until the bias current value reaches a predetermined threshold value, the predetermined threshold value being indicative of a minimum value at which the switching time of the load is shortened.

16. A device for controlling a load, comprising:

an activation device supplying the load with different current values in different phases, wherein the load receives, before being activated, a bias current value that is less than a current value for causing a response in the load; and an arrangement adapting the bias current value as a function of a switching time of the load, the arrangement maintaining the adapted bias current value at a predetermined level for a time period prior to activation of the load.

* * * * *